US007675477B2

(12) United States Patent
Leisten

(10) Patent No.: US 7,675,477 B2
(45) Date of Patent: Mar. 9, 2010

(54) DIELECTRICALLY-LOADED ANTENNA

(75) Inventor: Oliver Paul Leisten, Raunds (GB)

(73) Assignee: Sarantel Limited, Wellingborough (GB)

( * ) Notice: Subject to any disclaimer, the term of this patent is extended or adjusted under 35 U.S.C. 154(b) by 111 days.

(21) Appl. No.: 12/005,127

(22) Filed: Dec. 20, 2007

(65) Prior Publication Data

US 2008/0174512 A1 Jul. 24, 2008

Related U.S. Application Data

(60) Provisional application No. 60/902,774, filed on Feb. 21, 2007.

(30) Foreign Application Priority Data

Dec. 20, 2006 (GB) ..... 0625392.6

(51) Int. Cl.
*H01Q 1/36* (2006.01)

(52) U.S. Cl. ..... 343/895

(58) Field of Classification Search ..... 343/895, 343/702, 859–860, 905
See application file for complete search history.

(56) References Cited

U.S. PATENT DOCUMENTS 3,599,220 A 8/1971 Dempsey
4,608,574 A 8/1986 Webster et al.
5,594,461 A * 1/1997 O'Neill, Jr. ..... 343/895
5,635,945 A 6/1997 McConnell et al.
5,706,019 A * 1/1998 Darden et al. ..... 343/895
5,854,608 A 12/1998 Leisten
5,859,621 A 1/1999 Leisten
5,945,963 A 8/1999 Leisten
5,963,180 A * 10/1999 Leisten ..... 343/895
6,011,524 A * 1/2000 Jervis ..... 343/895
6,094,178 A * 7/2000 Sanford ..... 343/895
6,133,891 A 10/2000 Josypenko
6,229,488 B1 5/2001 Lin et al.
6,300,917 B1 10/2001 Leisten et al.
6,369,776 B1 4/2002 Leisten
6,552,693 B1 * 4/2003 Leisten ..... 343/895
6,690,336 B1 2/2004 Leisten
6,886,237 B2 5/2005 Leisten et al.
6,914,580 B2 7/2005 Leisten
7,002,530 B1 2/2006 Chung et al.
7,256,752 B2 * 8/2007 Wither et al. ..... 343/905
7,268,745 B2 9/2007 Yang et al.

(Continued)

FOREIGN PATENT DOCUMENTS

CN 2899134 5/2007

(Continued)

*Primary Examiner*—Huedung Mancuso
(74) *Attorney, Agent, or Firm*—John Bruckner PC

(57) ABSTRACT

A dielectrically-loaded helical antenna has a cylindrical ceramic core bearing metallised helical antenna elements which are coupled to a coaxial feeder structure passing axially through the core. Secured to an end face of the core is a circular laminate board having feed-through holes for receiving the end portions of feeder structure conductors. Coupling conductors on the face of the board that faces the core extend radially outwardly from connections with the feeder structure conductors to plated edge portions of the board. The board is of a diameter substantially equal to that of the core and bridging conductors overlying the plated edge portions connect the coupling conductors to the helical elements. The board incorporates a matching network.

11 Claims, 3 Drawing Sheets

U.S. PATENT DOCUMENTS

| | | | | |
|---|---|---|---|---|
| 2005/0115056 | A1* | 6/2005 | Leisten et al. | 29/601 |
| 2005/0195126 | A1 | 9/2005 | Leisten | |
| 2006/0022891 | A1 | 2/2006 | O'Neill, Jr. et al. | |
| 2006/0022892 | A1* | 2/2006 | O'Neill et al. | 343/895 |
| 2006/0038739 | A1 | 2/2006 | Feng et al. | |
| 2006/0097950 | A1 | 5/2006 | Wither et al. | |
| 2007/0063918 | A1 | 3/2007 | Leisten | |
| 2007/0063919 | A1 | 3/2007 | Leisten | |

FOREIGN PATENT DOCUMENTS

| | | |
|---|---|---|
| EP | 0469741 | 2/1992 |
| EP | 1076378 | 2/2001 |
| GB | 2292257 | 2/1996 |
| GB | 2424521 | 9/2006 |
| TW | I238566 | 8/1993 |
| WO | WO 00/48268 | 8/2000 |
| WO | WO 2006/136809 | 12/2006 |

* cited by examiner

DIELECTRICALLY-LOADED ANTENNA

CROSS-REFERENCES TO RELATED APPLICATIONS

This application claims a benefit of priority under 35 U.S.C. 119(e) from copending provisional patent application U.S. Ser. No. 60/902,774, filed Feb. 21, 2007, the entire contents of which are hereby expressly incorporated herein by reference for all purposes. This application is related to, and claims a benefit of priority under one or more of 35 U.S.C. 119(a)-119(d) from copending foreign patent application 0625392.6, filed in the United Kingdom on Dec. 20, 2006 under the Paris Convention, the entire contents of which are hereby expressly incorporated herein by reference for all purposes.

BACKGROUND INFORMATION

1. Field of the Invention

This invention relates to a dielectrically-loaded antenna for operation at frequencies in excess of 200 MHz.

2. Discussion of the Related Art

Such antennas are disclosed in a number of patent publications of the present applicant, including GB2292638A, GB2309592A, GB2310543A, GB2338605A, GB2346014A GB2351850A and GB2367429A. Each of these antennas has at least one pair of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feed structure comprising an inner conductor surrounded by a shield conductor. At one end of the core the feed structure conductors are connected to respective antenna elements which have associated connection portions adjacent the end of the bore. At the other end of the bore, the shield conductor is connected to a conductor which links the antenna elements and, in each of these examples, is in the form of a conductive sleeve encircling part of the core to form a balun. Each of the antenna elements terminates on a rim of the sleeve and each follows a respective helical path from its connection to the feed structure.

Some of the above prior patent publications disclose quadrifilar helical antennas. Each of these antennas has four helical tracks plated on the cylindrical surface of the core, or four groups of helical tracks, each group comprising two tracks separated by a narrow slit. Whether the antenna has four helical tracks or two, the connection portions connecting the antenna elements to the feed structure conductors are radial tracks plated on a planar end surface of the core.

It is known to provide a quadrifilar helical with an impedance matching network. This may be embodied as a printed circuit board depending from the end surface of the core opposite to that bearing the radial connection portions, or it may take the form of a small printed circuit or laminate board secured to the top end face of the core where it provides coupling between the feed structure and radial connection portions such as those disclosed in the above-mentioned prior patent publications. An antenna having such a matching network is disclosed in our co-pending U.S. patent application Ser. No. 11/472,587. The matching network comprises a capacitor connected in parallel across the inner and shield feed conductors, and a series inductance between the inner conductor and the connection portions associated with two of the helical tracks. Connections between the laminate board and the radial connection portions on the end face of the core are made by solder fillets between plated edge portions of the laminate board and the tracks of the radial connection portions, the laminate board lying flat on the core end face.

SUMMARY OF THE INVENTION

It is an object of the invention to provide a simplified structure.

According to a first aspect of this invention, there is provided a dielectrically-loaded antenna for operation at frequencies in excess of 200 MHz comprising: an electrically insulative core of a solid material having a relative dielectric constant greater than 5 and having transversely extending first and second end surfaces and a side surface which extends longitudinally between the end surfaces, the side and end surfaces of the core defining an interior volume the major part of which is occupied by the said solid material; a three-dimensional antenna element structure including at least a pair of elongate conductive antenna elements disposed on the side surface of the core and extending from the first end surface towards the second end surface; a laminate board on the first end surface of the core in face-to-face juxtaposition therewith and extending to the periphery of the first end surface; and a feed connection comprising a pair of feed terminations on the board; the laminate board including coupling conductors on the face of the board that faces the core, the coupling conductors coupling the feed terminations to the elongate antenna elements at the periphery of the first end surface of the core. As in the prior antennas referred to above, the core preferably has a central longitudinal axis. The feed terminations are located in the region of the axis and the coupling conductors typically comprise generally radially extending tracks on the said face of the laminate board, hereinafter referred to as the "underside" of the laminate board. Each of these tracks ends in registry with the periphery of the first end surface of the core.

The core material preferably has a relative dielectric constant greater than 10, with a figure between 25 and 100 being typical.

The laminate board preferably includes a matching circuit. This matching circuit typically has at least one reactive component connected in parallel between the coupling conductors. This may be a capacitance comprising a first plate on the underside of the board formed integrally with at least one of the radially extending tracks, and a second plate formed as a conductive layer sandwiched between the insulative layers of the board and in registry with the first plate.

The board may have a feedthrough connection between (a) a first track forming part of one of a plurality of conductive layers of the laminate board, this first track being connected to one of the feed terminations, and (b) one of the coupling conductors formed by a conductive layer on the underside of the board. The laminate board includes a thin insulative layer between these two conductive layers and may be made of a ceramic-loaded material to yield a relative dielectric constant of 5 or greater. In a preferred embodiment, the relative dielectric constant of the material is less than half that of the material of the antenna core.

The preferred antenna is cylindrical, the laminate board being formed as a circular disc having the same diameter as the core so that the edge of the board is flush with the cylindrical side surface of the core. The edge of the board preferable has plated portions which are electrically connected to the outer ends of the coupling conductors, the antenna further comprising bridging conductors bonded to the plated edge portions and to the end portions of the elongate antenna elements adjacent the first end surface of the core. The bridging conductors conveniently comprise small metallic tape portions soldered to the plated edge portions of the laminate board and to the end portions of the elongate antenna elements.

It will be noted that, by forming coupling conductors on the laminate board coupling the feed terminations to the elongate antenna elements, the need for plating or otherwise depositing metallic conductors on the first end face of the core is avoided. Since at least portions of the coupling conductors form part of the radiating conductor structure of the antenna, they are formed on the underside of the laminate board where they are adjacent the first end surface of the core. In particular, the relevant conductors are in face-to-face abutting contact with the ceramic material of the core end surface. In this way, variations in the electrical lengths of the resonant loop or loops formed by the antenna elements and the coupling conductors are reduced, and the full effect of the dielectric material of the core on the lengths of the coupling conductors is maintained.

According to a second aspect of the invention, there is provided a dielectrically-loaded antenna for operation at frequencies in excess of 200 MHz comprising: an electrically insulative core of a solid material having a relative dielectric constant greater than 5 and having transversely extending first and second end surfaces and a side surface which extends longitudinally between the end surfaces, the side and end surfaces of the core defining an interior volume the major part of which is occupied by the said solid material; a three-dimensional antenna element structure including at least a pair of elongate conductive antenna elements disposed on the side surface of the core and extending from the first end surfaces towards the second end surface; a laminate board on the first end surface of the core in face-to-face juxtaposition therewith and extending to the periphery of the first end surface; and a feed connection comprising a pair of feed terminations on the board; wherein the laminate board includes coupling conductors formed as a layer or layers of the board, the coupling conductors coupling the feed terminations to the elongate antenna elements at the periphery of the one end surface of the core; and wherein the laminate board further includes plated edge portions that are electrically continuous with the coupling conductors and in registry with end portions of the elongate antenna elements at the said core end surface periphery; the antenna further comprising bridging conductors overlying and conductively bonded to the plated edge portions and the antenna element end portions to form the connections between the coupling conductors and the elongate antenna elements.

The invention also includes a feed structure for an antenna, the feed structure having the features set out above.

BRIEF DESCRIPTION OF THE DRAWINGS

The invention will now be described by way of example with reference to the drawings in which.

DESCRIPTION OF PREFERRED EMBODIMENTS

Figure 1:
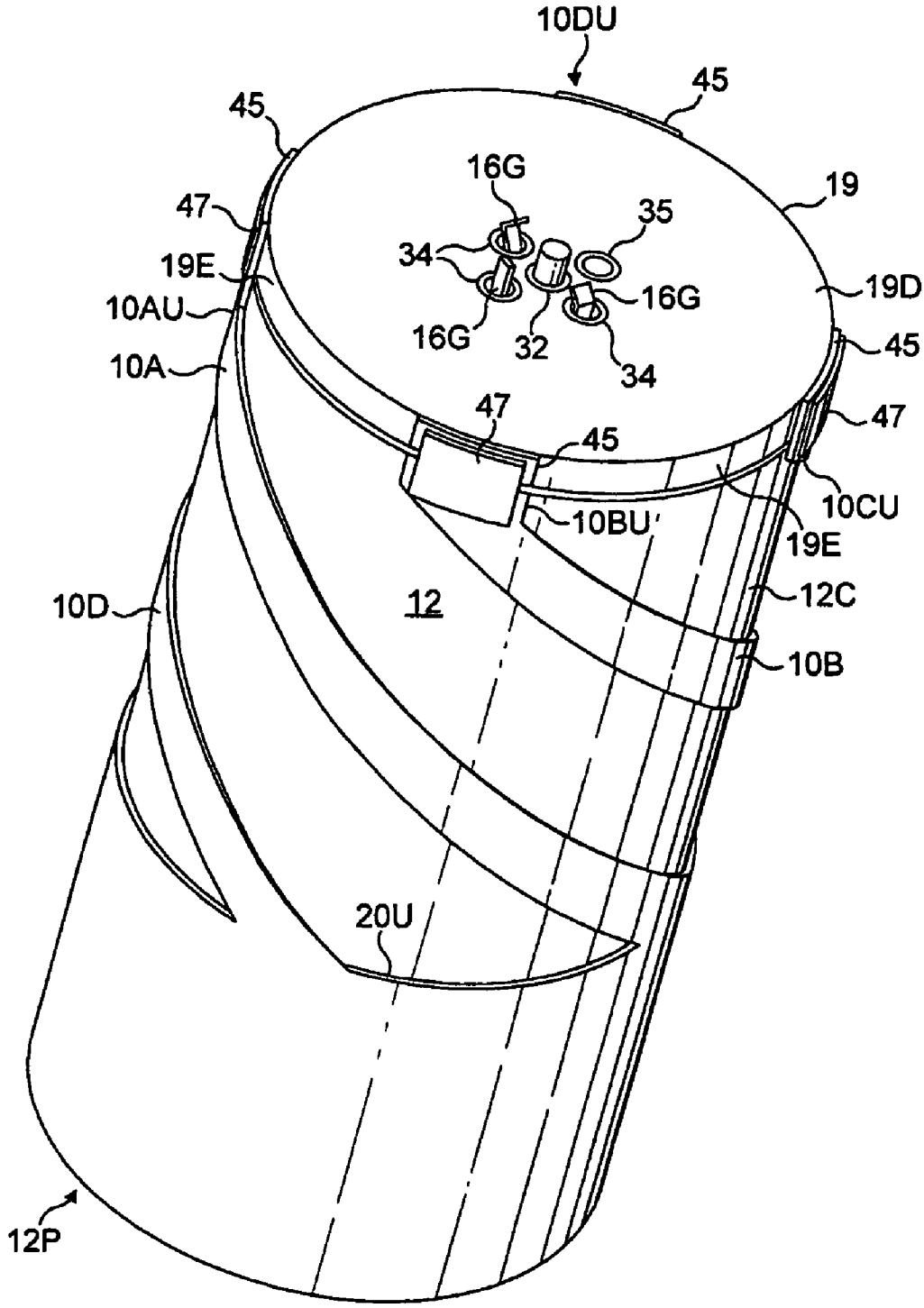
FIG. 1 is a perspective view of a quadrifilar helical antenna in accordance with the invention, viewed from above and the side.
Figure 2:
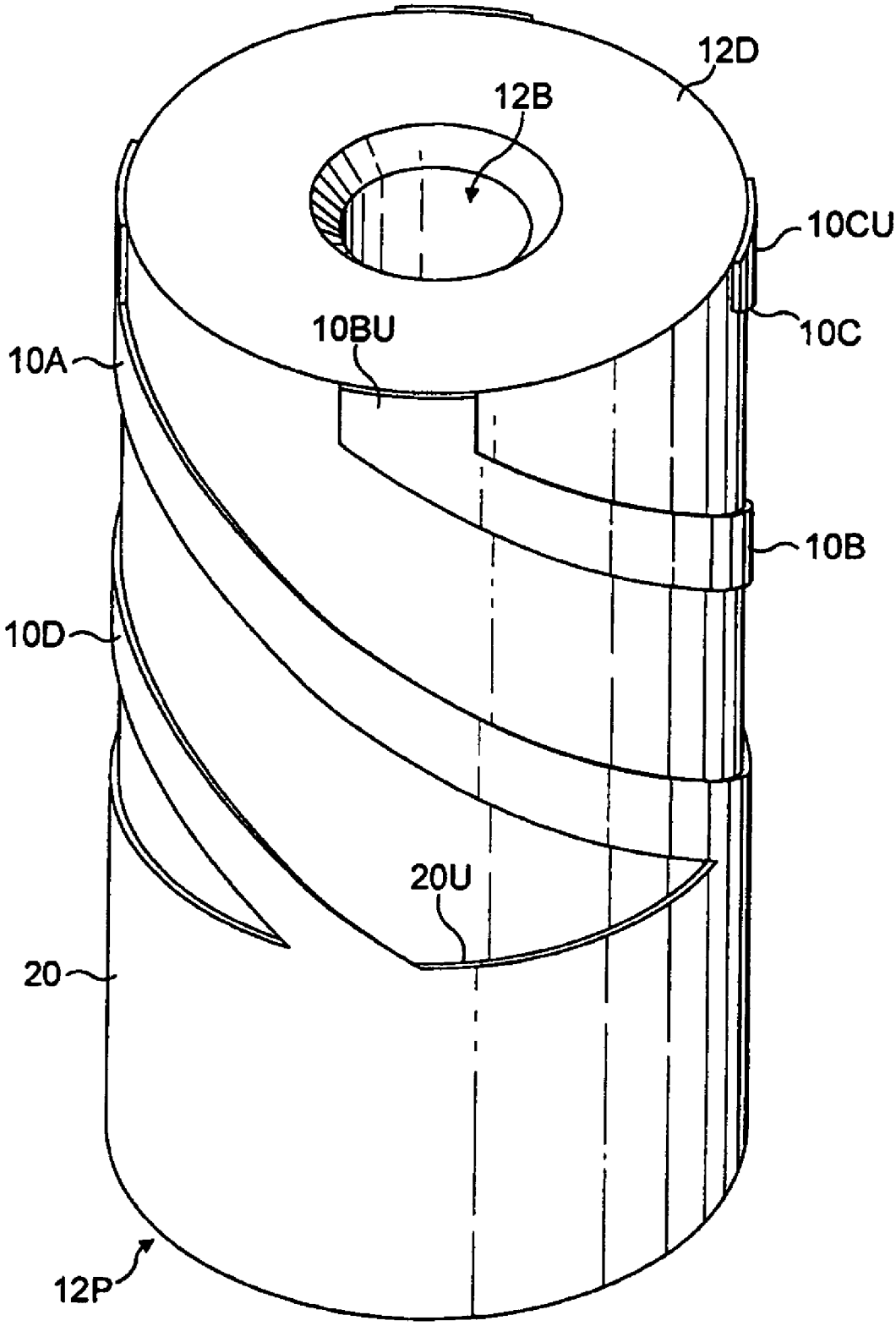
FIG. 2 is a perspective view of the plated antenna core, showing an upper (distal) surface of the core.

Referring to FIGS. 1 and 2, a quadrifilar helical antenna in accordance with the invention has an antenna element structure with four axially coextensive helical tracks 10A, 10B, 10C, 10D plated or otherwise metallised on the cylindrical outer surface of a cylindrical ceramic core 12. The core is made of a ceramic material. In this case it is a barium titanate material having a relative dielectric constant of 36. This material is noted for its dimensional and electrical stability with varying temperature. Dielectric loss is negligible. In this embodiment, the core has a diameter of 10 mm. The length of the core is greater than the diameter but, in other embodiments of the invention, it may be less. The core is produced in an extrusion process, but may be produced by pressing.

This preferred antenna is a backfire helical antenna in that it has a coaxial transmission line housed in an axial bore 12B which passes through the core from a distal end face 12D to a proximal end face 12P of the core. Both end faces 12D, 12P are planar and perpendicular to the central axis of the core. They are oppositely directed, in that one is directed distally and the other proximally in this embodiment of the invention. The coaxial transmission line is a rigid coaxial feeder which is housed centrally in the bore 12B with the outer shield conductor spaced from the wall of the bore 12B so that there is, effectively, a dielectric layer between the shield conductor 16 and the material of the core 12. Details of the coaxial transmission line feeder and its mounting in the core 12 are described in more detail in the above-mentioned co-pending U.S. patent application Ser. No. 11/472,587. Part of the feeder is shown diagrammatically in FIG. 3. It comprises a rigid metallic shield conductor 16, an inner insulating layer 17 which may be air or a plastics sleeve, and an elongate inner conductor 18 having a distal end portion in the form of a pin 18D. The characteristic impedance of the feeder is 50 ohms. The feeder serves to couple the antenna elements 10A-10D to radio frequency (RF) circuitry of equipment to which the antenna is to be connected, the connections to such equipment being made at the proximal end of the antenna. The couplings between the antenna elements 10A-10D and the feeder 16-18 are made via coupling conductors on a laminate board 19 secured to the distal end face 12D of the core as will be seen by comparing FIGS. 1, 2 and 3. The feeder and the laminate board comprise a unitary feed structure before assembly into the core.

The proximal ends of the antenna elements 10A-10D are connected to a common virtual ground conductor 20. In this embodiment, the common conductor is annular and in the form of a plated sleeve surrounding a proximal end portion of the core 12. This sleeve 20 is, in turn, connected to the shield conductor 16 of the feeder by a plated conductive covering of the proximal end face 12P of the core 12.

The four helical antenna elements 10A-10D are of different lengths, two of the elements 10B, 10D being longer than the other two 10A, 10C as a result of the rim 20U of the sleeve 20 being of varying distance from the distal end face 12D of the core. Where the shorter antenna elements 10A, 10C are connected to the sleeve 20, the rim 20U is a little nearer the distal end face 12D than it is where the longer antenna elements 10B, 10D are connected to the sleeve 20.

The conductive sleeve 20, the plating on the proximal end face 12P of the core, and the outer shield 16 of the feeder 16 together form a quarterwave balun that provides common-mode isolation of the radiating antenna element structure from the equipment to which the antenna is connected when installed. The metallised conductor elements formed by the antenna elements and other metallised layers on the core define an interior volume which is occupied by the core, the major part of this volume being occupied by the solid material of the core which dielectrically loads the antenna element structure.

At the operating frequency of the antenna, it operates in a mode of resonance in which the antenna is sensitive to circularly polarised signals. The differing lengths of the antenna elements 10A-10D result in phase differences between currents in the longer elements 10B, 10D and those in the shorter elements 10A, 10C respectively. In this resonant mode, currents flow around the rim 20U between, on the one hand, the elements 10C, 10D which are coupled to the inner feed conductor 18 and, on the other hand, the elements 10A, 10B which are connected to the shield 16 by the coupling conductors of the laminate board 19, as will be described below. The sleeve 20 and the plating on the proximal end face 12P of the core together act as a trap preventing the flow of currents from the antenna elements 10A-10D to the shield conductor 16 at the proximal end face 12P of the core.

Further details of the feed structure will now be described. The feed structure comprises the combination of the coaxial 50 ohm line 16, 17, 18 and the planar laminate board 19 which is connected to a distal end of the coaxial line. The laminate board 19 is in the form of a printed circuit board lying flat against the distal end face of the core 12 in face-to-face contact. The laminate board 19 is in the form of a disc with a perpendicular edge surface 19E. The diameter of the disc is exactly equal to the diameter of the core 12 so that the edge surface 19E is flush with the cylindrical side surface 12C of the core 12, as shown in FIG. 1.

Figure 3:
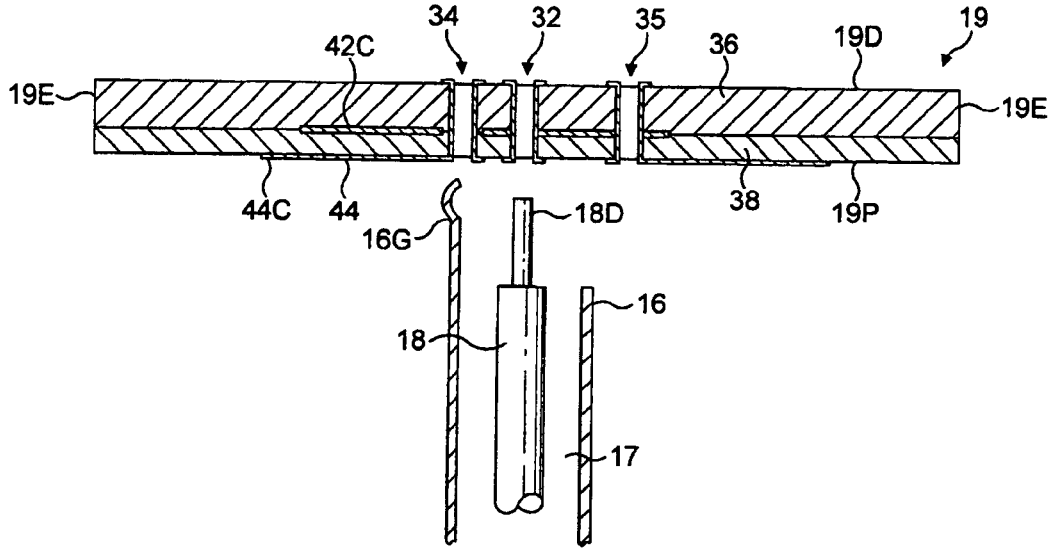
FIG. 3 is a cross section of part of a feeder structure comprising a coaxial feeder and a laminate board perpendicular to the axis of the feeder and embodying a matching network.

Referring to FIGS. 1 and 3, the board 19 has a substantially central hole 32 which receives the distal pin 18D of the inner conductor 18 of the coaxial line. Three off-centre holes 34 receive distal lugs 16G (only one of which appears in FIG. 3) of the shield conductor 16. Lugs 16G are bent or "jogged" to assist in locating the laminate board with respect to the coaxial line. All four holes 32, 34 are plated through, as will be seen in FIG. 3. In addition, a fourth plated-through hole 35 extends between the major surfaces of the board 19 at a radius greater than that of the shield conductor 16 of the coaxial feed.

The laminate board 19 is a multiple layer board that has a plurality of insulative layers and a plurality of conductive layers. In this embodiment, there are two insulative layers comprising a distal layer 36 and a proximal layer 38. There are three conductor layers as follows: a distal layer 40, an intermediate layer 42, and a proximal layer 44.

Figure 4A:
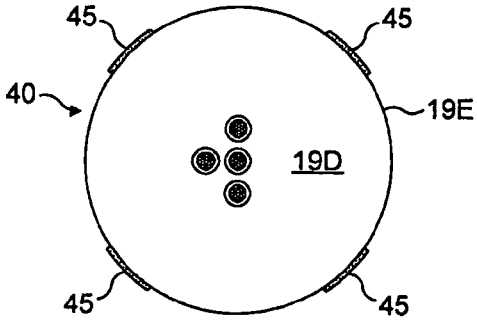
FIGS. 4A, 4B and 4C are diagrams showing the conductor patterns of different conductor layers of the laminate board shown in FIG. 3.
Figure 4B:
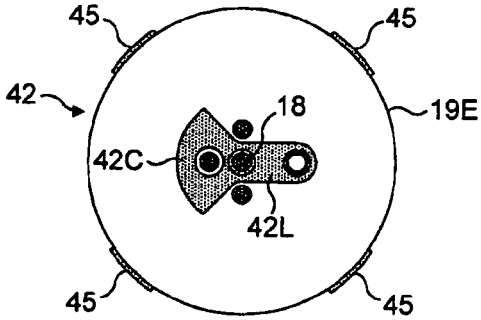
Figure 4C:
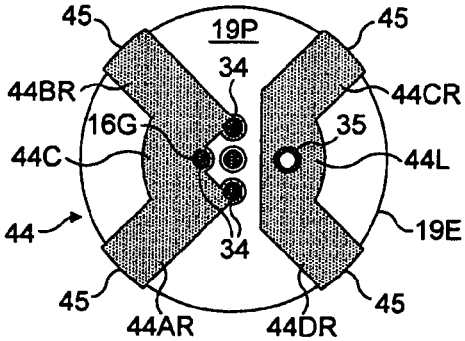

The intermediate conductor layer 42 is sandwiched between the distal and proximal insulative layers 36, 38, as shown in FIG. 3. Each conductor layer is etched with a respective conductor pattern, as shown in FIGS. 4A-4C. Where the conductor pattern extends to the periphery of the laminate board 19, the edge surface is coated (in this case, plated) to form plated edge portions 45 which span the edge surface 19E from the proximal surface 19P of the board towards the distal surface 19D (in this case reaching the edge of the distal surface 19D). Where the conductor pattern meets the plated-through holes 32, 34, 35 (hereinafter referred to as "vias"), the respective conductors in the different layers are interconnected by the via plating.

As will be seen from FIG. 4B, the intermediate conductive layer 42 has a first conductor area 42C in the shape of a fan or sector extending radially from a connection to the inner conductor 18 of the coaxial feed (when its distal end portion 18D is seated in via 32) in the direction of the elongate antenna elements 10A, 10B (compare with FIG. 1). Directly beneath this conductive area 42C, the proximal conductive layer 44 has a generally sector-shaped area 44C extending from a connection with the shield conductor 16 of the coaxial feed (when received in vias 34) to a pair of radially extending conductive tracks 44AR, 44BR which terminate in respective plated edge portions 45 at the periphery of the board 19. In this way, a shunt capacitor is formed between the inner feeder conductor 18 and the feeder shield conductor 16, the material of the proximal insulative layer 38 acting as a capacitor dielectric. This material typically has a dielectric constant greater than 5.

The conductor pattern of the intermediate conductive layer 42 is such that it has a second conductor area 42L extending from the connection with the inner feeder conductor 18 to the open via 35, as shown in FIG. 4B. At its outer end, conductor area 42L overlies a linking part 44L of the proximal conductive layer 44 linking two further radially extending tracks 44CR, 44DR which, like their counterpart tracks 44AR, 44BR, terminate in respective plated edge portions 45, as shown in FIG. 4C. The conductive area 42L acts as a series inductance in a conductive path between the inner feed conductor 18 and the respective radially extending tracks 44CR, 44DR.

As an alternative conductor pattern, the inductance link between the connection to the inner feed conductor 18 and the respective radially extending tracks 44CR, 44DR may be formed by an inductive conductor track in the proximal conductive layer 44 between the centre of the link 44L and the central via 32, dispensing with the open via 35 and the inductive track 42L (see FIGS. 4B and 4C). In this variant, the shield conductor 16 is reduced in length on one side of the inner feed conductor 18 to avoid contact with the inductive conductor track.

By comparing FIG. 4C, which is an underside view of the proximal face 19P of the laminate board 19, with FIG. 1, it will be seen that the radially extending tracks 44AR-44DR lie flat in an abutting relationship on the distal end surface 12D (see FIG. 2) of the core 12 and are each in registry with a respective upper end portion 10AU, 10BU, 10CU, 10DU of a respective one of the helical tracks 10A-10D.

In assembly of the antenna, when the feed structure, in the form of a combination of the laminate board 19 and the coaxial feeder 16-18, is mounted in the core 12 with the proximal face 19P of the laminate board 19 in contact with the distal face 12D of the core 12, and with the radially extending tracks 44AR-44DR on the underside of the board 19 in registry with the respective upper end portions 10AU-10DU of the helical antenna elements 10A-10D, connections are made between the respective plated edge portions 45 and the antenna element upper end portions 10AU-10DU by rectangular copper tape portions 47, each tape portion overlying one of the plated edge portions 45 and upper end portions 10AU-10DU to act as a bridging conductor. In this way, the inner and shield conductors 18, 16 are each coupled, via the matching network formed by the above-described capacitance and inductance, to a respective pair of helical antenna elements 10C, 10D; 10A, 10B. Since each of the helical antenna elements 10A-10D is connected to the balun sleeve 20 and the sleeve acts as a quarterwave trap at the operating frequency of the antenna, currents flow between the proximal ends of the helical antenna elements 10A-10B along the rim 20U (see FIG. 1) of the sleeve 20 so that two resonant loops are formed, each extending from one of the feed conductors 16, 18, via a first one of the radially extending tracks 44AR-44DR on the laminate board 19, a first bridging conductor 47, a first one of the helical elements 10A-10D, the sleeve rim 20U, a second one of the helical elements which is diametrically opposite the first, another of the bridging conductors 47, and a second one of the radially extending tracks on the board 19 which is 180° opposite the first such track in the loop, and thence to the other feed conductor. The topology and radiating structure of the dielectrically-loaded quadrifilar helical antennas described in the above-referenced prior patent publications has been largely reproduced in a way which avoids having to form conductive tracks directly on the distal end face 12D of the core 12.

The copper tape portions 47, forming the bridging conductors between the conductors of the laminate board 19 and those plated on the core are applied by, firstly, depositing spots of solder paste on the plated edge portions 45 and the upper end portions 10AU-10DU of the helical elements using a needle applicator. The tape portions may then be picked up automatically by a suction device and placed on the deposited solder paste where they are held in position by surface tension of the paste. Solder paste having also previously been applied to the vias 32, 34 of the laminate board 19, the assembled antenna is moved into an oven whereupon the solder paste spreads out beneath the tape portions 47 and in the vias 32, 34 to make the respective electrical connections. It is not essential to leave the soldering of the distal pin 18D of the inner feeder conductor and the lugs 16G of the shield conductor in the vias 32, 34 until the soldering of the bridging conductors 47 is performed. If desired, this soldering step can be carried out before the feeder structure is inserted in the core 12. In either method, however, the feeder structure is assembled before it is inserted into the core, so that it is inserted as an easily handled unitary structure.

The structure and assembly of the antenna shares many other features with the antennas disclosed in the above-referenced patent publications, the contents of which are incorporated herein by reference. In particular, the materials, construction and functioning of the coaxial feeder, and the laminate board and its matching network, are described in more detail in the above-referenced U.S. patent application Ser. No. 11/472,587, the contents of which are also incorporated herein by reference.

The invention claimed is:

1. A dielectrically-loaded antenna for operation at frequencies in excess of 200 MHz comprising: an electrically insulative core of a solid material having a relative dielectric constant greater than 5 and having transversely extending first and second end surfaces and a side surface which extends longitudinally between the end surfaces, the side and end surfaces of the core defining an interior volume the major part of which is occupied by the said solid material; a three-dimensional antenna element structure including at least a pair of elongate conductive antenna elements disposed on the side surface of the core and extending from the first end surface towards the second end surface; a laminate board on the first end surface of the core in face-to-face juxtaposition therewith and extending to the periphery of the first end surface; and a feed connection comprising a pair of feed terminations on the board; the laminate board including coupling conductors on the face of the board that faces the core, the coupling conductors coupling the feed terminations to the elongate antenna elements at the periphery of the first end surface of the core.

2. An antenna according to claim 1, wherein the core has a central longitudinal axis and the feed terminations are located in the region of the axis, and wherein the coupling conductors comprise generally radially extending tracks on the said face of the laminate board, each of which tracks ends in registry with the periphery of the first end surface of the core.

3. An antenna according to claim 2, including an axial feeder passing through the core and terminating at the said feed termination, the feeder and the laminate board comprising a unitary feed structure.

4. An antenna according to claim 1, wherein the laminate board includes a matching circuit having at least one reactive component connected in parallel between the coupling conductors.

5. An antenna according to claim 2 or claim 3, wherein the laminate board includes a matching circuit having at least a capacitance connected in parallel between the coupling conductors, which capacitance comprises a first plate on the said face of the board formed integrally with at least one of the radially extending tracks and a second plate formed as a conductive layer sandwiched between insulative layers of the board and in registry with the first plate.

6. An antenna according to claim 4, wherein the board has a plurality of conductive layers separated by at least one insulative layer and a feedthrough connection between (a) a first track forming part of one of the conductive layers and connected to one of the feed terminations and (b) one of the coupling conductors on the said face of the board.

7. An antenna according to any of claims 1-4 or claim 6, wherein the core is cylindrical and the laminate board is formed as a disc having the same diameter as the core, and wherein the edge of the board has plated portions which are electrically connected to outer ends of the coupling conductors, the antenna further comprising bridging conductors bonded to the plated edge portions and to end portions of the elongate antenna elements adjacent the first end surface of the core.

8. A quadrifilar helical antenna according to claim 2 or claim 3, having four said radially extending tracks on the said face of the laminate board.

9. A dielectrically-loaded antenna for operation at frequencies in excess of 200 MHz comprising: an electrically insulative core of a solid material having a relative dielectric constant greater than 5 and having transversely extending first and second end surfaces and a side surface which extends longitudinally between the end surfaces, the side and end surfaces of the core defining an interior volume the major part of which is occupied by the said solid material; a three-dimensional antenna element structure including at least a pair of elongate conductive antenna elements disposed on the side surface of the core and extending from the first end surfaces towards the second end surface; a laminate board on the first end surface of the core in face-to-face juxtaposition therewith and extending to the periphery of the first end surface; and a feed connection comprising a pair of feed terminations on the board; the laminate board includes coupling conductors formed as a layer or layers of the board, the coupling conductors coupling the feed terminations to the elongate antenna elements at the periphery of the first end surface of the core; and wherein the laminate board further includes plated edge portions that are electrically continuous with the coupling conductors and in registry with end portions of the elongate antenna elements at the said core end surface periphery; the antenna further comprising bridging conductors overlying and conductively bonded to the plated edge portions and the antenna element end portions to form the connections between the coupling conductors and the elongate antenna elements.

10. An antenna according to claim 9, wherein the bridging conductors comprise metallic tape portions soldered to the plated edge portions of the laminate board and to the end portions of the elongate antenna elements.

11. An antenna according to claim 10, wherein the core is cylindrical and the laminate board is circular, the diameter of the board matching that of the core so that the tape portions lie parallel to the axis of the core.

* * * * *